US005604402A

United States Patent [19]

Symons

[11] Patent Number: 5,604,402

[45] Date of Patent: Feb. 18, 1997

[54] HARMONIC GYRO TRAVELING WAVE TUBE HAVING A MULTIPOLE FIELD EXCITING CIRCUIT

[75] Inventor: Robert S. Symons, Los Altos, Calif.

[73] Assignee: Litton Systems, Inc., Woodland Hills, Calif.

[21] Appl. No.: 381,138

[22] Filed: Jan. 31, 1995

[51] Int. Cl.[6] ..... H01J 25/00

[52] U.S. Cl. ..... 315/5; 315/5.43; 330/43

[58] Field of Search ..... 315/4, 5, 5.43; 331/79, 82; 330/43

[56] References Cited

U.S. PATENT DOCUMENTS

| | | | |
|---|---|---|---|
| 4,114,121 | 9/1978 | Barlow | 333/239 |
| 4,225,806 | 9/1980 | Lé Gardeur | 315/5 |
| 4,480,234 | 10/1984 | Wachtel | 315/5 X |
| 5,187,408 | 2/1993 | Jödicke et al. | 331/79 X |

OTHER PUBLICATIONS

Cyclotron Resonance Devices, by R. S. Symons and H. R. Jory; Academy Press, Inc., 1981.

*Primary Examiner*—Benny T. Lee

*Attorney, Agent, or Firm*—Graham & James LLP

[57] ABSTRACT

A harmonic gyro-TWT is provided that has only one possible mode of operation. The harmonic gyro-TWT comprises a waveguide and an electron beam projected through the waveguide and encircling an axis of the waveguide. A plurality of evenly spaced electrical conductors are disposed within the waveguide parallel to the axis and spaced a fixed distance from an inner wall of the waveguide. The electrical conductors are connected together at an end of the waveguide. The electrical conductors are excited in phase with an AC signal connected between the electrical conductors and the inner wall of the waveguide. As a result, a multipole field having an order equal to twice the number of electrical conductors is defined within the waveguide. A plurality of support rails couple the inside surface of the waveguide to each respective one of the plurality of electrical conductors. The distance between adjacent ones of the support rails is approximately equal to ¼ of a wavelength of a center frequency of a desired passband of the harmonic gyro-TWT, and the distance between the inner wall of the waveguide and the electrical conductors along a respective one of the support rails is approximately equal to ¼ of a wavelength of a center frequency of a desired passband of the harmonic gyro-TWT.

12 Claims, 7 Drawing Sheets

HARMONIC GYRO TRAVELING WAVE TUBE HAVING A MULTIPOLE FIELD EXCITING CIRCUIT

BACKGROUND OF THE INVENTION

1. Field of the Invention

The present invention relates to high power traveling wave tubes (TWTs) having gyrating electron beams, and more particularly, to a harmonic gyro-TWT having a multipole field that propagates at a frequency lower than all other possible waveguide modes.

2. Description of Related Art

Electron cyclotron resonance devices, also known as "fast-wave" tubes, refer to a particular class of high power microwave tubes. As in other "slow-wave" microwave tubes, an electron beam that passes through the device interacts with a propagating electromagnetic wave to produce amplification of the wave. Slow-wave tubes include a radio-frequency (RF) structure configured so that the phase velocity of the electromagnetic wave is slowed to the electron beam velocity. In contrast, the RF structure of fast-wave tubes comprises a smooth waveguide or a large resonator in which no attempt is made to reduce the velocity of the propagating electromagnetic wave through the device. Instead, the electron beam is injected into the electromagnetic field in a manner such that interaction can take place.

In cyclotron resonance devices, such as gyrotrons, gyro klystrons, gyro-TWTs, and gyro backward wave oscillators (BWOs), electrons of the electron beam have substantial motion perpendicular to the axis of the beam and a focusing magnetic field, and thus rotate in a helical path around a central axis. The electrons interact with RF fields perpendicular to the magnetic focusing field. As the electrons rotate and the fields alternate in synchronism, there is a cumulative interaction in which some electrons gain energy and other electrons lose energy. The electrons that gain energy undergo a relativistic-mass increase, and the ones that lose energy undergo a relativistic-mass decrease. Thus, the cyclotron frequencies of the electrons decrease or increase respectively, and as a result, the electrons gather into rod-like bunches that rotate around the axis of the helix.

The rotating electron bunches interact with a multipole field of order equal to twice the number of the desired harmonic interaction. For example, there will be a strong interaction between a $TE_{31}$ mode in which the waveguide field which has six cusps of electric field and a beam rotating at one-third the frequency of the electromagnetic wave in the waveguide, assuming that the diameter of the axis-encircling electron beam is sufficiently large, or the transverse energy of the electron beam is large with respect to its axial energy. For example, an 80 kilovolt beam travels at a velocity about equal to half the velocity of light, and therefore, the diameter of an axis-encircling electron beam in which the transverse energy corresponds to 80 kilovolts will have a diameter about half of the diameter of a waveguide propagating the $TE_{31}$ mode.

While an interaction between such a beam and such a waveguide mode may be desirable for certain applications, it may not always be desirable to generate quite as much power as such a beam would be capable of producing. If the energy of the beam is reduced, however, the diameter of the beam will also reduce correspondingly, and the beam will not encounter strong fields near the axis of a $TE_{31}$ mode. The use of fins projecting inward from the wall of the circular waveguide has been suggested as a way to strengthen the field at such small diameters and to improve the interaction impedance.

Nevertheless, the fins further complicate the already complex mode structure of the waveguide. The use of fins will cause the waveguide to propagate in numerous modes all having strong fields. Each of the pie-shaped resonators defined between the fins can support a different mode with high fields between the ends of the fins when the fins are about a quarter of a wavelength long. Many of the modes that exist in the waveguide can be represented as differently phased combinations of the modes that exist in the individual pie-shaped resonators. That is, if the phase of the electric field in all of the pie-shaped resonators is in the same direction, a field pattern is defined that is equivalent to the $TE_{01}$ circular electric mode. The $TE_{31}$ mode described above is the mode that would exist if the phase in each of the pie-shaped resonators alternates from one resonator to the next. If the phase of three of the pie-shaped resonators on one side of the waveguide is in one direction and the three pie-shaped resonators on the other side is in the opposite direction, this mode would correspond to the TEll mode in a circular waveguide.

Since the resonant frequency of an individual one of the pie-shaped resonators is determined by its fin length, all of the various waveguide modes that are perturbed by the fins will now occur at frequencies very close to one another. For example, if the electron beam is a little-off center, a $TE_{21}$ mode may be excited in the waveguide. Numerous other interactions are possible if the beam is modulated with modes in which the electric field is axial (TM modes) and still get azimuthal bunching which can interact with TE modes or even the radial fields of TM modes.

Accordingly, it would be desirable to provide a waveguide for a harmonic gyro-TWT that would not have the problem of nearby propagating modes that interact with the beam simultaneously with the desired mode. More specifically, it would be desirable to provide within a gyro-TWT a mode having an electric field in a high-order multipole configuration that propagates at a frequency lower than that of all of other possible modes of the waveguide.

SUMMARY OF THE INVENTION

In accordance with the teachings of the present invention, a harmonic gyro-TWT with only one possible mode of operation is provided.

The gyro-TWT comprises a waveguide and an electron beam projected through the waveguide and encircling an axis of the waveguide. A plurality of evenly spaced electrical conductors are disposed within the waveguide parallel to the axis and spaced a fixed distance from an inside surface of the waveguide. The electrical conductors are connected together at an end of the waveguide. The electrical conductors are excited in phase with an AC signal connected between the electrical conductors and the inside surface of the waveguide. As a result, a multipole field having an order equal to twice the number of electrical conductors is defined within the waveguide.

In an embodiment of the invention, a plurality of support rails couple the inside surface of the waveguide to each respective one of the plurality of electrical conductors. The distance between adjacent ones of the support rails is approximately equal to ¼ of a wavelength of a center frequency of a desired passband of the gyro-TWT, and the distance between the inside surface of the waveguide and the electrical conductors along a respective one of the support rails is approximately equal to ¼ of a wavelength of a center frequency of a desired passband of the gyro-TWT.

A more complete understanding of the harmonic gyro-TWT circuit will be afforded to those skilled in the art, as well as a realization of additional advantages and objects thereof, by a consideration of the following detailed description of the preferred embodiment. Reference will be made to the appended sheets of drawings which will first be described briefly.

DETAILED DESCRIPTION OF THE PREFERRED EMBODIMENT

The present invention provides an ideal circuit for a harmonic gyro-TWT that avoids the problem of nearby propagating modes which might interact with the beam simultaneously with the desired mode. The harmonic gyro-TWT provides a mode with an electric field in a high-order multipole configuration which would propagate at a frequency lower than that of all of other possible waveguide modes of the circuit.

Figure 1:
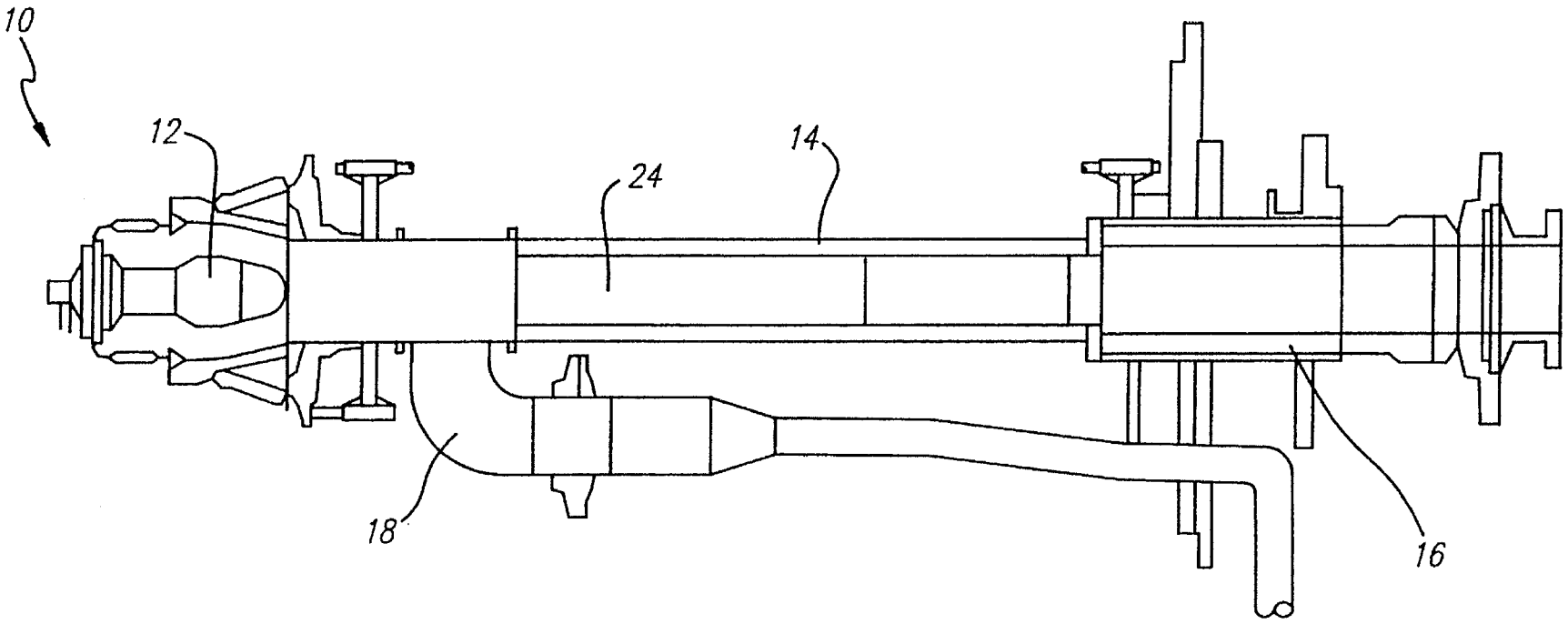
FIG. 1 PRIOR ART
FIG. 1 illustrates a prior art gyro-TWT.
Figure 2:
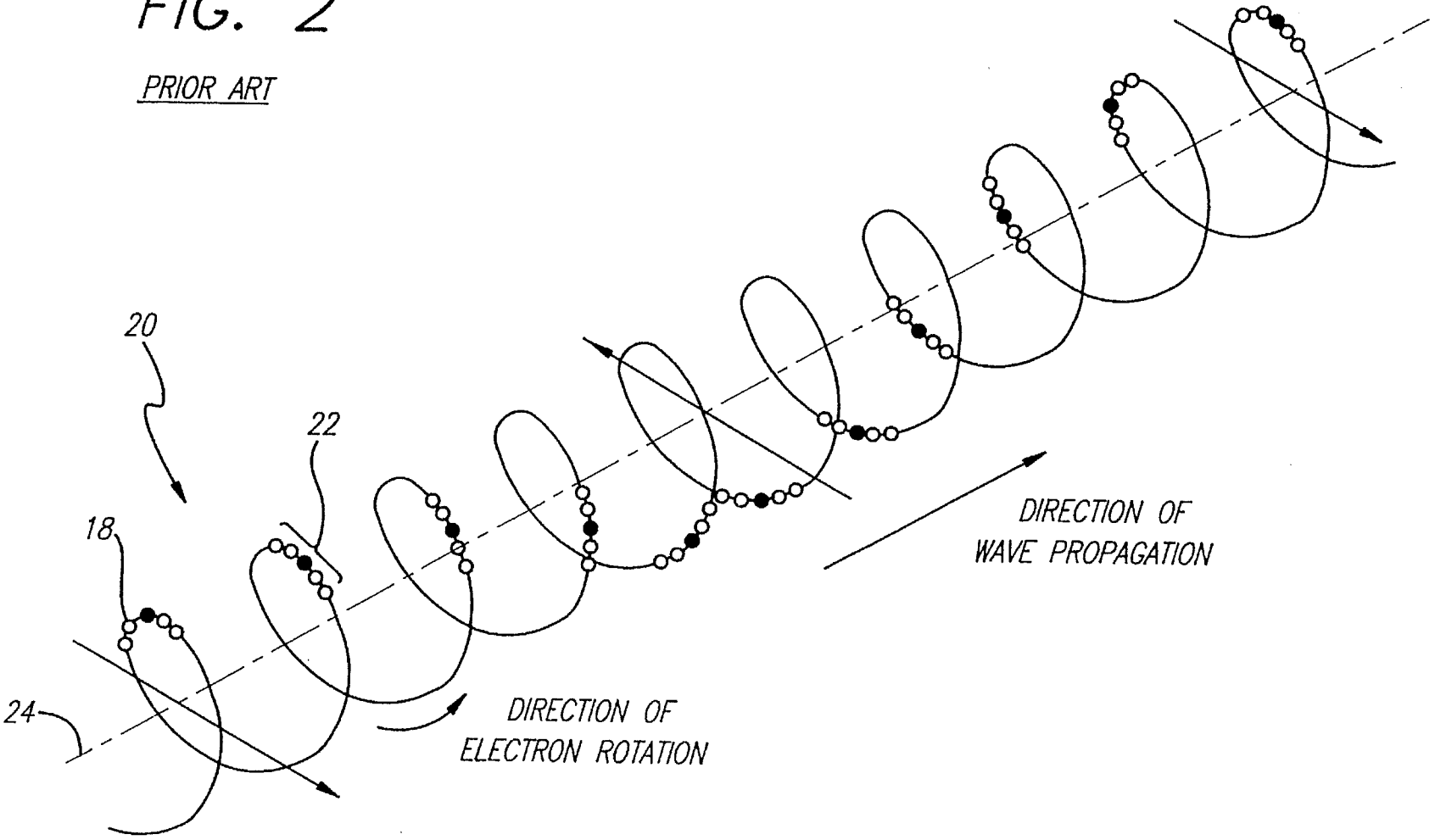
FIG. 2 PRIOR ART
FIG. 2 illustrates a gyrating electron beam of a prior art gyro-TWT.

Referring first to FIG. 1, a prior art gyro-TWT 10 is illustrated. The gyro-TWT 10 comprises an electron gun 12, an interaction waveguide 14, and a collector 16. The electron gun 12 provides a gyrating electron beam 244 that propagates through the interaction waveguide 14 to the collector 16. The collector 16 dissipates the remaining energy of individual electrons of the electron beam after it has passed through the interaction waveguide 14. An input waveguide 18 couples an RF electromagnetic wave input signal to the interaction waveguide 14. Axial phase synchronism occurs between the RF wave propagating along the direction shown and the electrons rotating in the direction shown as is illustrated in FIG. 2. Individual electrons 18 of the electron beam 20 gather into rod-like bunches 22 that rotate around a helical axis 24 of the interaction waveguide 14 (see FIG. 1).

Figure 3:
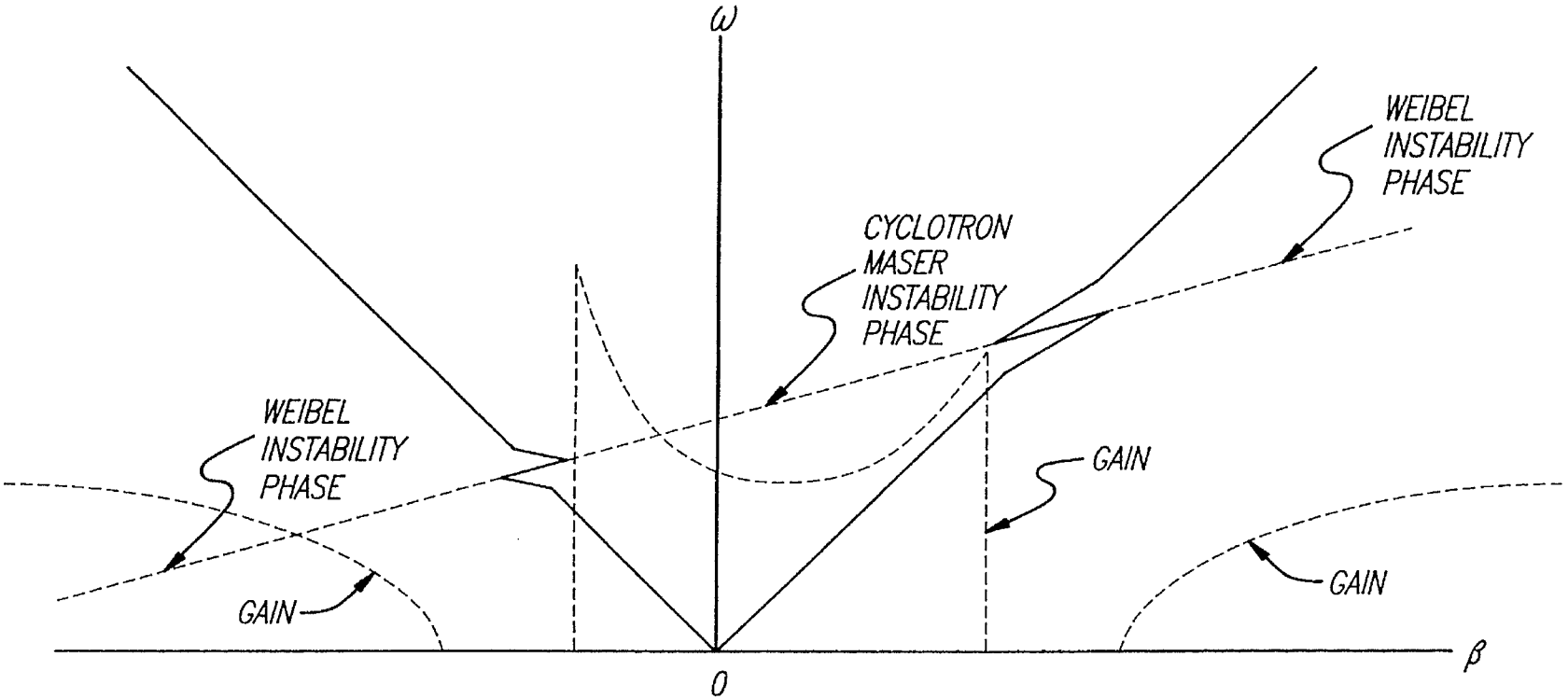
FIG. 3 is a graph illustrating dispersion relations for beam-wave systems in which a cyclotron resonance beam line crosses a waveguide dispersion relation at frequencies far from cutoff.

FIG. 3 illustrates the frequency phase relationship ($\omega$-$\beta$ diagram) for a harmonic gyro-TWT, in which $\omega$ represents angular frequency and $\beta$ represents the wave number, phase constant, or the inverse of the distance between adjacent wave fronts. The two solid lines represent the propagating characteristic of the electromagnetic wave at the TEM mode. The intersecting broken line represents the propagating characteristics of the gyrating electron beam. The region along the dotted line between the two solid lines is referred to as the cyclotron maser instability phase, and the region along the dotted line outside the two solid lines is referred to as the Weibel instability phase. It is generally undesirable to operate the harmonic gyro-TWT in the Weibel instability phase, since there is axial bunching of the electron beam due to the transverse electric fields.

By superposing gain measurements with respect to $\omega$ onto the graph of FIG. 3, an interesting phenomenon can be observed. The gain measurements have peaks at the intersection between the beam and wave phase velocity curves, representing the boundary region between the cyclotron maser instability phase and the Weibel instability phase regions. The graph of FIG. 3 illustrates that there are regions on the right-hand side of the graph in which the gain relationship varies in a near-linear manner with the beam phase velocity, representing a useful convective instability. Thus, by introducing a low frequency cutoff in the multipole mode that exists within the harmonic gyro-TWT it is possible to provide a more conventional harmonic gyro-TWT dispersion diagram.

Referring now to FIGS. 4 through 7, various embodiments of a interaction waveguide are illustrated that would be capable of providing a low frequency cutoff sufficient to cause the harmonic gyro-TWT to operate in the desired range illustrated in FIG. 3. In each of the embodiments, the waveguide has a number of electrical conductors placed at equal angles inside the wall of the waveguide at a diameter somewhat less than that of the waveguide. If all of these electrical conductors are connected together at the ends of the waveguide where an axis-encircling electron beam might enter or leave the waveguide and are excited in the same phase with an AC signal connected between the electrical conductors and the wall of the pipe, then a multipole field having an order equal to twice the number of electrical conductors will exist within the waveguide.

Figure 4:
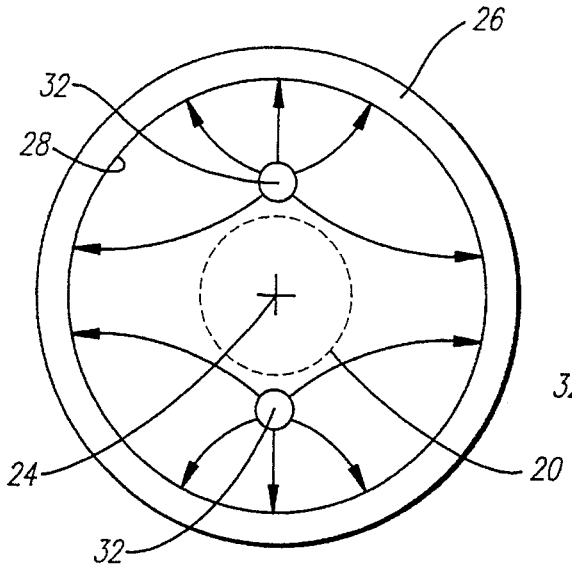
FIG. 4 is a cross-sectional end view of a circular waveguide having quadrupole fields.
Figure 5:
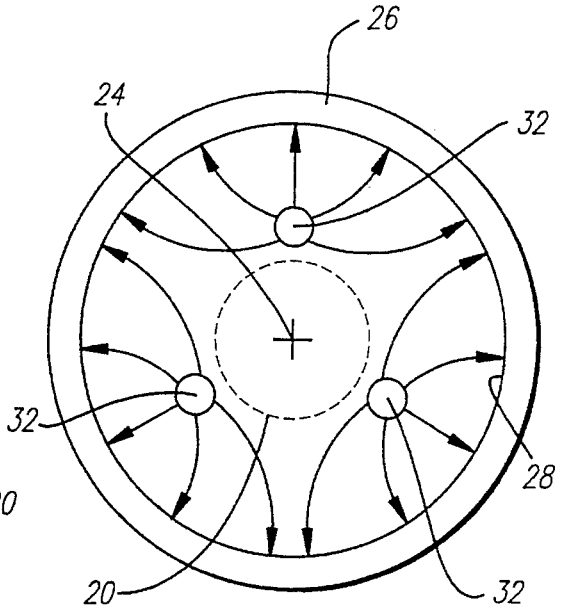
FIG. 5 is a cross-sectional end view of a circular waveguide having hexapole fields.

FIGS. 4 and 5 illustrate waveguide sections 26 having circular cross section with a gyrating electron beam 20 that rotates around a helical axis 24 of the waveguide. A plurality of electrical conductors 32 extend in a direction parallel to the axis 24 and are spaced a fixed distance from an inner wall 28 of the waveguide section 26. The electrical conductors 32 are comprised of an electrically conductive material and have a generally circular cross section, such as copper wire. FIG. 4 illustrates an embodiment of the waveguide section 26 having two electrical conductors 32 spaced 180° apart, and FIG. 5 illustrates an embodiment of the waveguide section having three electrical conductors spaced 120° apart.

An electromagnetic field operating in the TEM mode is defined between the electrical conductors and the inner wall 28 of the waveguide section 26, and is illustrated by the arrows. The waveguide sections 26 of FIGS. 4 and 5 illustrate quadrupole or hexapole fields defined by the two or three electrical conductors within the waveguide section 26. It is should be apparent that a multipole field of any desired order can be obtained by increasing the number of electrical conductors.

Figure 6:
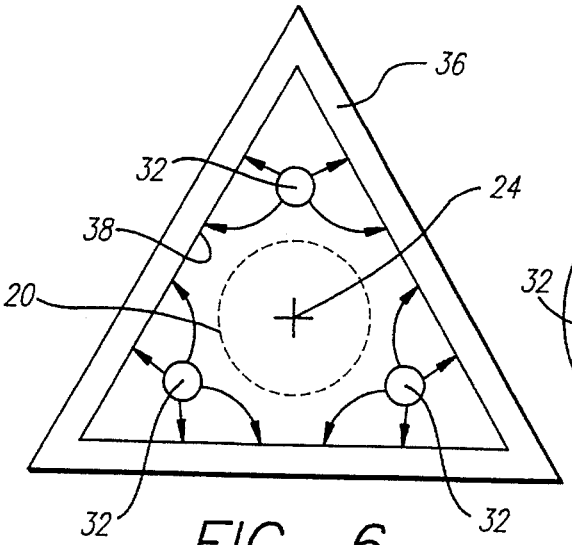
FIG. 6 is a cross-sectional end view of a triangular waveguide having hexapole fields.
Figure 7:
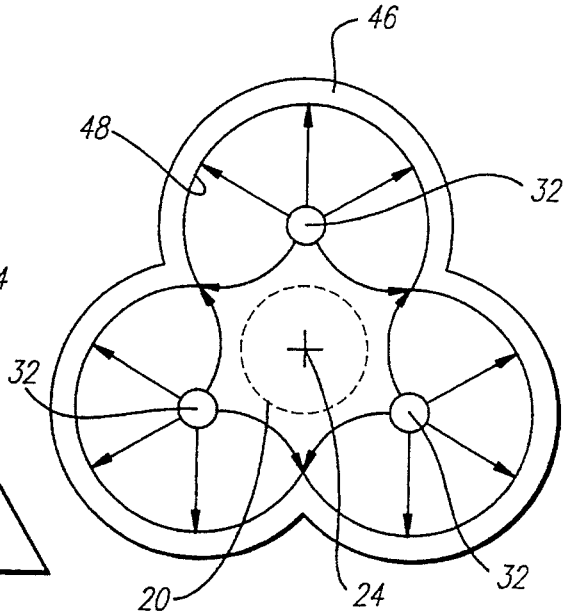
FIG. 7 is a cross-sectional end view of a cloverleaf waveguide having hexapole fields.

FIGS. 6 and 7 illustrate alternative ways of shaping the waveguide section to either reduce the mean circumference of the circuit and increase the frequency at which a higher order mode will occur at the expense of electric field strength in the beam (FIG. 6), or to increase the field strength in the beam at the expense of mode problems (FIG. 7). FIG. 6 illustrates an embodiment of a waveguide section 36 having triangular cross section with a gyrating electron beam 20 that rotates around a helical axis 24 of the waveguide. Three electrical conductors 32 spaced 120° apart extend in a direction parallel to the axis 24 and are spaced from an inner wall 38 of the waveguide section 36. An electromagnetic field operating in the TEM mode is defined between the electrical conductors 32 and the inner wall 38 of the waveguide section 36, and is illustrated by the arrows.

FIG. 7 illustrates an embodiment of a waveguide section 46 having a cloverleaf-shaped cross-section with a gyrating electron beam 20 that rotates around a helical axis 24 of the waveguide. Three electrical conductors 32 spaced 120° apart extend in a direction parallel to the axis 24 and are spaced from an inner wall 48 of the waveguide section 46. An electromagnetic field operating in the TEM mode is defined between the electrical conductors 32 and the inner wall 48 of the waveguide section 46, and is illustrated by the arrows.

Figure 8:
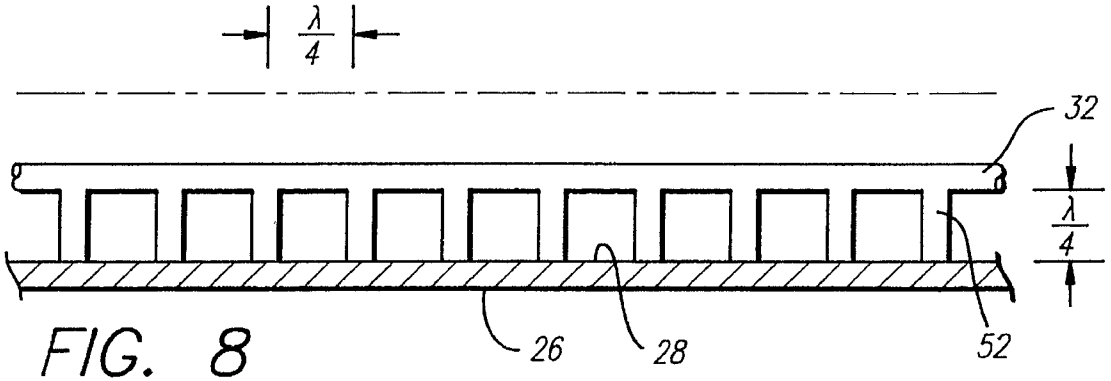
FIG. 8 is a cross-sectional side view of a waveguide showing a plurality of support rails coupling a wire to an inside surface of the waveguide.

Referring now to FIG. 8, a side cross-section of the waveguide section 26 is illustrated to show the physical connection between the electrical conductors 32 and the inner wall 28 of the waveguide. A plurality of evenly spaced support rails 52 couple the electrical conductors to the inner wall 28. The support rails 52 are spaced apart such that a distance between adjacent ones of the support rails is equal to ¼ of a wavelength (i.e., $\lambda/4$) of a center frequency of a desired passband of the harmonic gyro-TWT. Similarly, a distance between the inner wall 28 of the waveguide section 26 and the electrical conductors 32 along a respective one of the support rails 52 is equal to ¼ of a wavelength (i.e., $\lambda/4$) of a center frequency of a desired passband of the gyro-TWT. By use of this spacing, the reflections introduced by the support rails will be small and will cancel in a frequency band around the center frequency. At lower frequencies, the support rails will short circuit the electrical conductors 32 to the inner wall 28. There will also be a stop band at a frequency at which the support rails are ½ of a wavelength apart and their reflections add.

Figure 9:
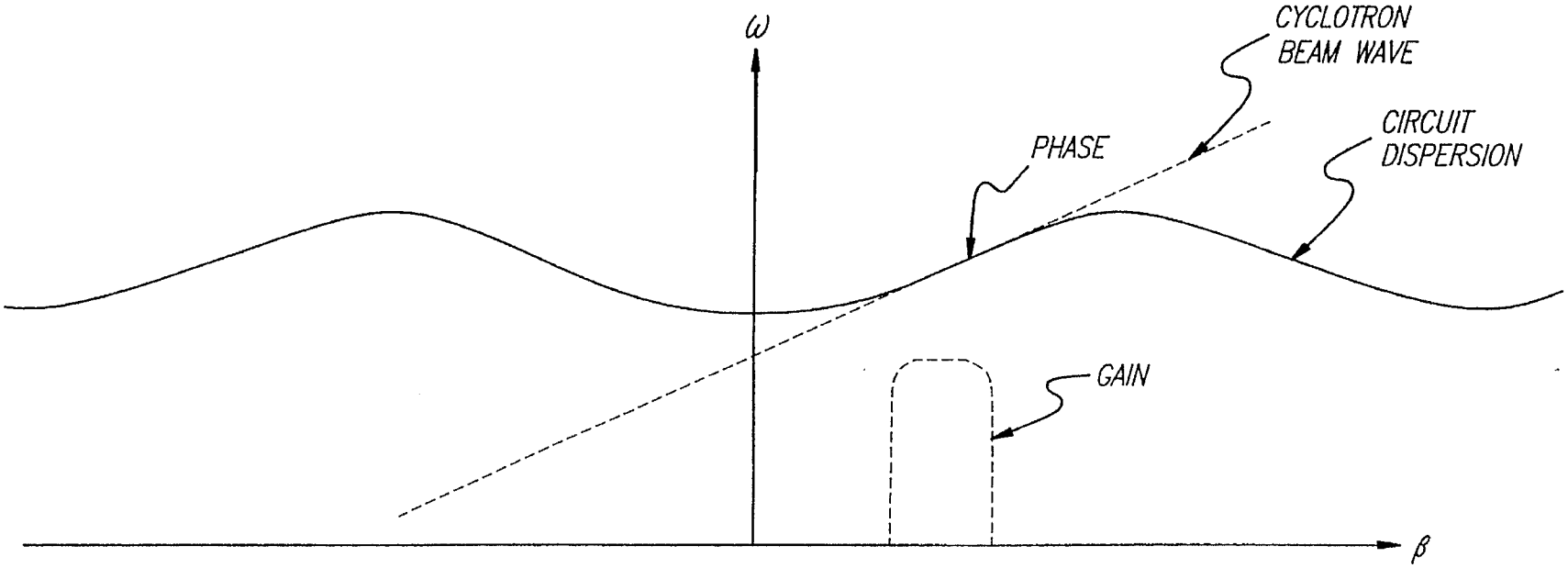
FIG. 9 is a graph as in FIG. 3, illustrating dispersion relations for beam-wave systems in which a cyclotron resonance beam line matches a waveguide dispersion relation.

FIG. 9 illustrates the phase velocity-frequency relationship ($\omega$-$\beta$ diagram) for a harmonic gyro-TWT constructed in accordance with the preferred embodiment of the present invention, in which $\omega$ represents angular frequency and $\beta$ represents the wave number. As in FIG. 3, the solid line represents the propagating characteristic of the electromagnetic wave at the TEM mode, and the intersecting broken line represents the propagating characteristics of the gyrating electron beam. In this case, the electromagnetic wave exhibits more desirable dispersion characteristics. The wave and beam lines correspond in phase over a range that coincides with a high gain region of the harmonic gyro-TWT (as shown by the region designated as "GAIN" in FIG. 9). It should be apparent that the high and low frequency cut-offs of the circuit can be adjusted so the group velocity of the circuit matches the cyclotron waves on an electron beam, as shown in FIG. 9.

Figure 11:
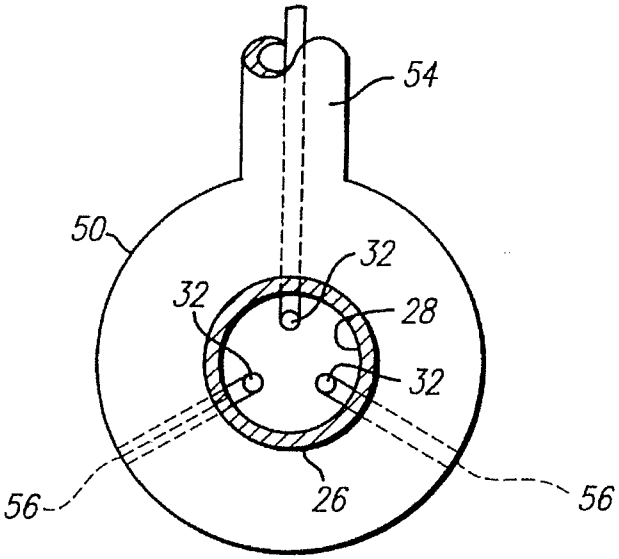
FIG. 11 is a cross-sectional end view of the waveguide as taken through the section 11—11 of FIG. 10.
Figure 10:
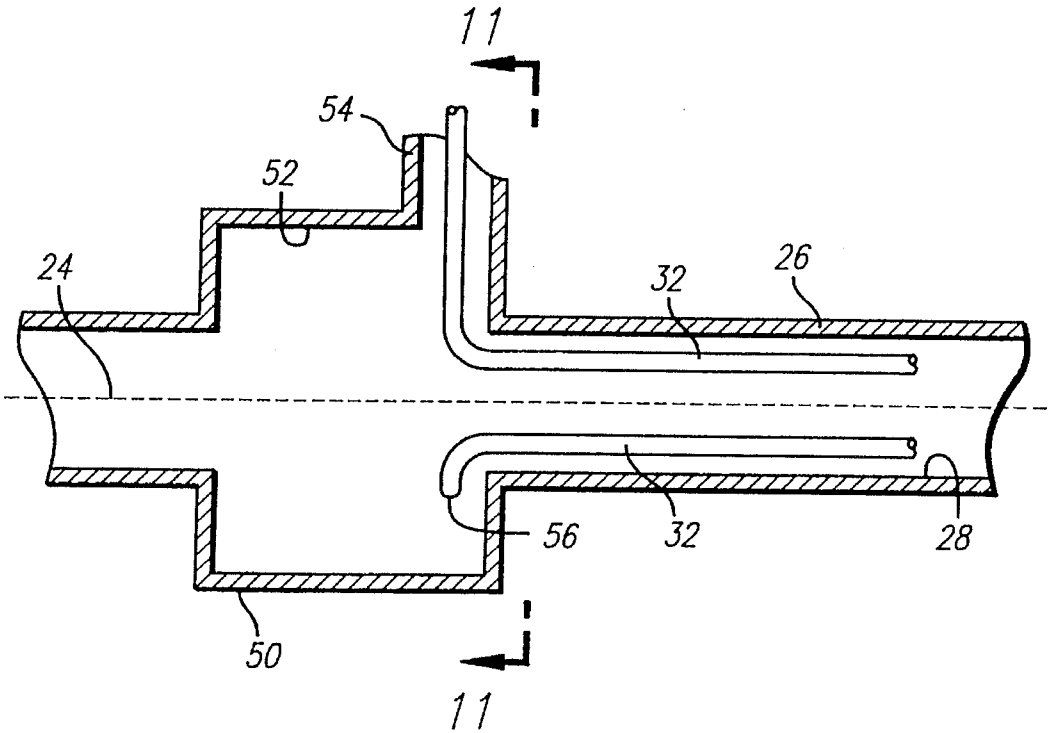
FIG. 10 is a cross-sectional side view of a waveguide having a single coaxial connection to an excitation cavity.

Referring finally to FIGS. 10 through 13, alternative embodiments are illustrated for coupling the electrical conductors 32 to an external AC source. In FIGS. 10 and 11, the circular waveguide section 26 is coupled to an excitation cavity 50. The excitation cavity has an inner cavity wall 52 (see FIG. 10) and a single coaxial input port 54. As in the circular cross-section embodiments described above, a gyrating electron beam 24 rotates around a helical axis 24 (see FIG. 10) of the waveguide 26 and the excitation cavity 50. Each of the electrical conductors 32 pass from the waveguide section 26 into the excitation cavity 50, and turn abruptly outward in a radial direction toward the cavity wall 52 of the excitation cavity 50. A single one of the electrical conductors 32 exits the cavity 50 through the coaxial port 54. The other electrical conductors 32 are coupled electrically to the cavity wall 52, as illustrated at 56 of FIGS. 10 and 11.

In operation, the single one of the electrical conductors 32 that is accessible through the port 54 is excited with an AC signal. The cavity 50 is configured to support a $TE_{311}$ mode, so that all of the electrical conductors 32 are excited in phase by the single AC input. A similar excitation cavity 50 may be disposed at an opposite end of the waveguide section 26, with a single one of the electrical conductors 32 coupled to an output sink. Alternatively, the three conductors 32 may be simply electrically connected to the internal wall 28 of the waveguide 26 at an end thereof.

Figure 13:
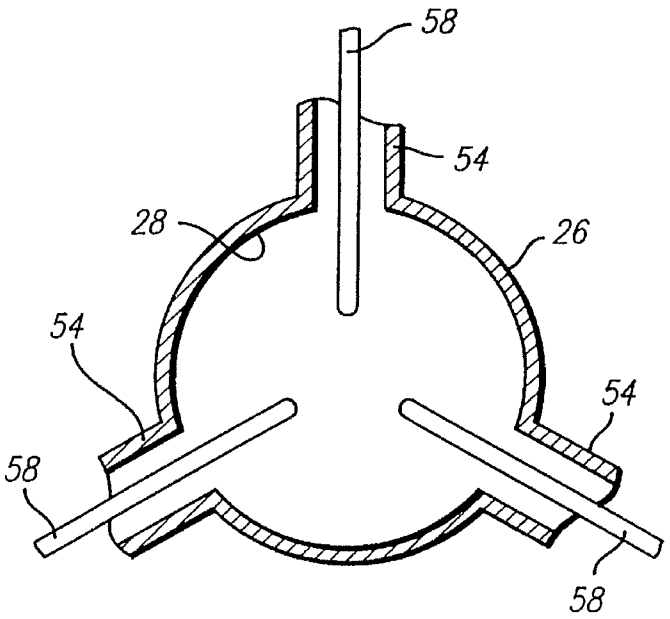
FIG. 13 is a cross-sectional end view of the waveguide as taken through the section 13—13 of FIG. 12.
Figure 12:
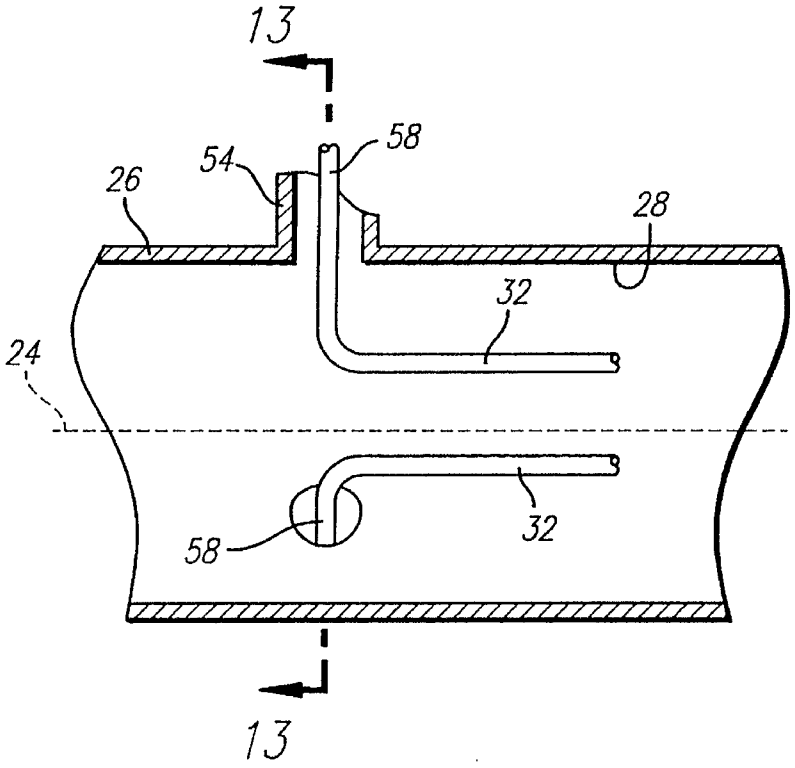
FIG. 12 is a cross-sectional side view of a waveguide having a three coaxial connections.

Alternatively, each of the electrical conductors 32 may be individually excited by one or more AC sources. FIGS. 12 and 13 illustrate the circular waveguide section 26 having three electrical conductors 32 (see FIG. 12) extending therethrough. Each of the electrical conductors 32 turn abruptly outward in the radial direction toward the interior wall 28 of the waveguide 26 and surround the helical axis 24 of the waveguide 26. Unlike the embodiment of FIGS. 10 and 11, a plurality of coaxial ports 54 are provided, and each one of the electrical conductors 32 exit the waveguide section 26 through a respective one of the ports. In order to ensure that each of the conductors 32 is excited in phase, it may be necessary to couple the coaxial conductors 58 to a power divider/combiner that is connected to a driver of the AC signal. Line lengths of each of the respective electrical conductors may need to be adjusted so as to insure proper phase equalization of the signal. Various techniques for controlling phase of a signal are known in the art and may be advantageously utilized in the present invention.

Having thus described a preferred embodiment of a harmonic gyro travelling wave tube circuit, it should be apparent to those skilled in the art that certain advantages of the within system have been achieved. It should also be appreciated that various modifications, adaptations, and alternative embodiments thereof may be made within the scope and spirit of the present invention. The invention is further defined by the following claims.

What is claimed is:

1. A harmonic gyro-TWT having means for projecting an electron beam, a waveguide and the electron beam projected through said waveguide encircling an axis of said waveguide, the gyro-TWT comprising:

a plurality of evenly spaced electrical conductors disposed within said waveguide parallel to said axis and spaced a first fixed distance from an inner wall of said waveguide, said electrical conductors being connected together at an end of said waveguide; and means for exciting said electrical conductors in phase with an AC signal, said exciting means being coupled to at least one of said electrical conductors;

wherein, a multipole field having an order equal to twice the number of said electrical conductors is defined within the waveguide.

2. The gyro-TWT of claim 1, further comprising a plurality of support rails coupling said inner wall of said waveguide to each respective one of said plurality of electrical conductors.

3. The gyro-TWT of claim 2, wherein a second distance between adjacent ones of said support rails is approximately equal to ¼ of a wavelength of a center frequency of a desired passband of said gyro-TWT.

4. The gyro-TWT of claim 2, wherein said first fixed distance between said inner wall of said waveguide and said electrical conductors along a respective one of said support rails is approximately equal to ¼ of a wavelength of a center frequency of a desired passband of said gyro-TWT.

5. The gyro-TWT of claim 1, wherein said plurality of evenly spaced electrical conductors further comprises at least two electrical conductors.

6. The gyro-TWT of claim 1, wherein said waveguide further comprises a circular-shaped cross-section.

7. The gyro-TWT of claim 1, wherein said waveguide further comprises a triangular-shaped cross-section.

8. The gyro-TWT of claim 1, wherein said waveguide further comprises a cloverleaf-shaped cross-section.

9. The gyro-TWT of claim 1, wherein each of said electrical conductors are comprised of a respective wire.

10. The gyro-TWT of claim 1, wherein said exciting means is connected between said at least one of said electrical conductors and said inner wall of said waveguide.

11. The gyro-TWT of claim 1, wherein said exciting means further comprises an excitation cavity having a single coaxial connection coupled to one of said electrical conductors.

12. The gyro-TWT of claim 1, wherein said excitation means further comprises a plurality of coaxial connections respectively coupled to said corresponding electrical conductors.

* * * * *